US008622052B1

(12) United States Patent
McPherson

(10) Patent No.: US 8,622,052 B1
(45) Date of Patent: Jan. 7, 2014

(54) ARCHERY BOW GRIP

(75) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 195 days.

(21) Appl. No.: 13/016,684

(22) Filed: Jan. 28, 2011

Related U.S. Application Data

(60) Provisional application No. 61/299,311, filed on Jan. 28, 2010.

(51) Int. Cl.
*F41B 5/14* (2006.01)

(52) U.S. Cl.
CPC ..... *F41B 5/14* (2013.01)
USPC ..... 124/88; 124/86

(58) Field of Classification Search
CPC ..... F41B 5/14
USPC ..... 124/86, 88
See application file for complete search history.

(56) References Cited

U.S. PATENT DOCUMENTS 3,176,674 A * 4/1965 Smith ..... 124/23.1
3,407,799 A * 10/1968 Bennett ..... 124/88
3,538,902 A * 11/1970 Fowkes ..... 124/88
3,814,074 A * 6/1974 Wood ..... 124/89
4,175,536 A * 11/1979 Carella ..... 124/23.1
4,257,385 A * 3/1981 Stewart ..... 124/24.1
4,693,230 A * 9/1987 Sugouchi ..... 124/88
4,919,107 A * 4/1990 Bunts ..... 124/24.1
4,966,124 A * 10/1990 Burling ..... 124/23.1
5,070,856 A * 12/1991 Plummer ..... 124/88
5,241,945 A * 9/1993 Shepley, Jr. ..... 124/88
5,243,958 A * 9/1993 Shepley, Jr. ..... 124/88
5,269,284 A * 12/1993 Pujos et al. ..... 124/88
5,291,874 A * 3/1994 Harrison ..... 124/23.1
5,333,595 A * 8/1994 Heffron ..... 124/88
5,349,937 A * 9/1994 Burling ..... 124/25.6
5,445,424 A * 8/1995 Binette ..... 294/217
5,469,834 A * 11/1995 Higgins et al. ..... 124/88
5,551,413 A * 9/1996 Walk ..... 124/88
5,615,663 A * 4/1997 Simonds ..... 124/88
5,617,838 A * 4/1997 Peruski ..... 124/88
5,682,871 A * 11/1997 Walk et al. ..... 124/88
5,697,358 A * 12/1997 Campisi ..... 124/88
5,701,880 A * 12/1997 Simonds ..... 124/88
5,842,460 A * 12/1998 Barber ..... 124/88
5,853,000 A * 12/1998 Torgerson et al. ..... 124/88
5,934,267 A * 8/1999 Briner ..... 124/88
6,662,798 B1 * 12/2003 Johnson ..... 124/88
6,988,495 B1 * 1/2006 Van Hoorn ..... 124/88

(Continued)

OTHER PUBLICATIONS

U.S. Appl. No. 61/299,311, filed Jan. 28, 2010; Inventor: Mathew A. McPherson.

*Primary Examiner* — Gene Kim
*Assistant Examiner* — Alexander Niconovich
(74) *Attorney, Agent, or Firm* — Vidas, Arrett & Steinkraus

(57) ABSTRACT

In at least one embodiment, an archery bow grip comprises a body portion comprising a first wall and an opposed second opposed wall. A connecting wall spans between the first wall and the second wall. The body portion defines a groove between an inner surface of said first wall and an inner surface of second wall. The groove defines a central axis, and the connecting wall comprises a ridge having a peak that extends parallel to the central axis of the groove. The peak is desirably straight along its length.

20 Claims, 6 Drawing Sheets

(56) References Cited

U.S. PATENT DOCUMENTS

| | | | | |
|---|---|---|---|---|
| 7,383,834 | B2 | 6/2008 | Budd | |
| 7,401,608 | B2 * | 7/2008 | Sheliga | 124/88 |
| 7,661,418 | B2 | 2/2010 | Bednar et al. | |
| D639,888 | S * | 6/2011 | McPherson | D22/107 |
| 2002/0073983 | A1 | 6/2002 | Etheridge et al. | |
| 2008/0127961 | A1 | 6/2008 | McPherson | |
| 2010/0089375 | A1 | 4/2010 | McPherson et al. | |
| 2011/0132344 | A1 * | 6/2011 | Moon et al. | 124/88 |

* cited by examiner

ARCHERY BOW GRIP

CROSS-REFERENCE TO RELATED APPLICATIONS

This application claims the benefit of U.S. Provisional Patent Application No. 61/299,311, filed Jan. 28, 2010, the entire disclosure of which is hereby incorporated herein by reference.

BACKGROUND OF THE INVENTION

This invention relates generally to archery bows and more specifically to a grip used on archery bows.

An archer holds an archery bow by the grip in one hand, for example the left hand. The other hand is used to draw back the bowstring. As the bowstring is drawn using the right hand, the grip applies a reactive force to the left hand. The force interaction between the hand and the grip can have undesirable effects that impact accuracy of arrow shots. For example, the hand can impart lateral and/or twisting forces to the bow. Various forces between the hand and bow grip can impart undesirable horizontal and/or vertical travel to the rear end of an archer bow at launch. Many prior grip designs include a large, curved shape, for example that matches a curved shape that the hand assumes when holding a bow. Although such designs are comfortable, force interactions that are offset from a center line of the bow/grip can induce undesirable lateral and/or twisting forces.

There remains a need for novel bow and grip designs that minimize undesirable force interactions between the shooter and the bow.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow grip comprises a body portion comprising a first wall and an opposed second opposed wall. A connecting wall spans between the first wall and the second wall. The body portion defines a groove between an inner surface of said first wall and an inner surface of second wall, the groove defining a central axis. The connecting wall further comprises a ridge having a peak that extends parallel to the central axis of the groove. The peak is desirably straight along its length.

In some embodiments, an archery bow comprises a riser, opposed limbs and a bowstring extending between the limbs. A grip is attached to the riser. The grip comprises a wall oriented between the riser and the bowstring. The wall comprises a ridge having a peak, wherein the peak is straight along its length. The bow defines a plane. The bowstring moves in the plane when the bow is drawn. The peak of the grip is oriented in the plane.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
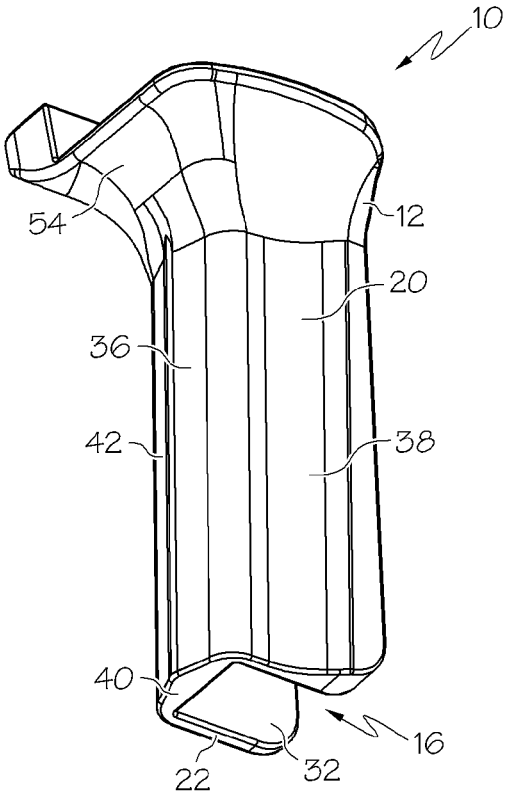
FIGS. 1-3 show views of an embodiment of an archery bow grip.
Figure 2:
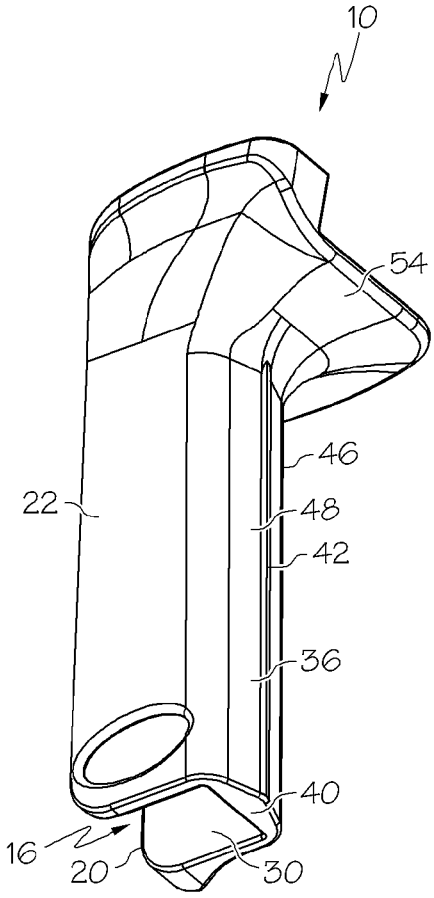
Figure 3:
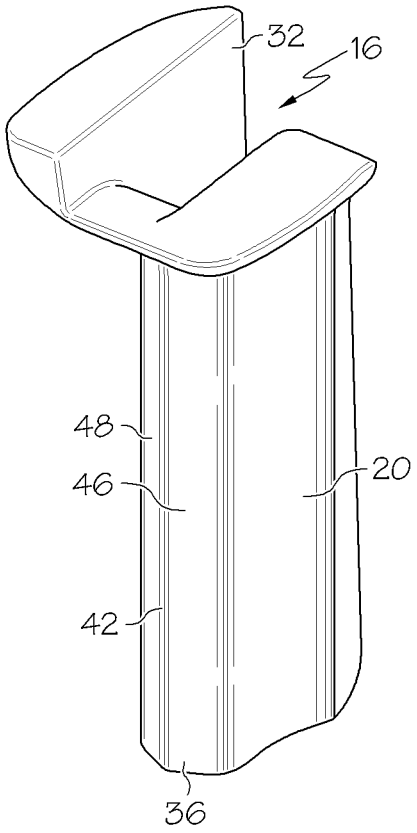
Figure 4:
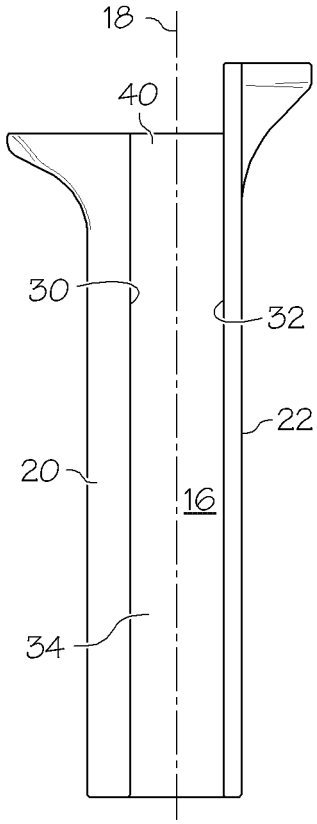
FIG. 4 shows a back view of an embodiment of an archery bow grip.
Figure 5:
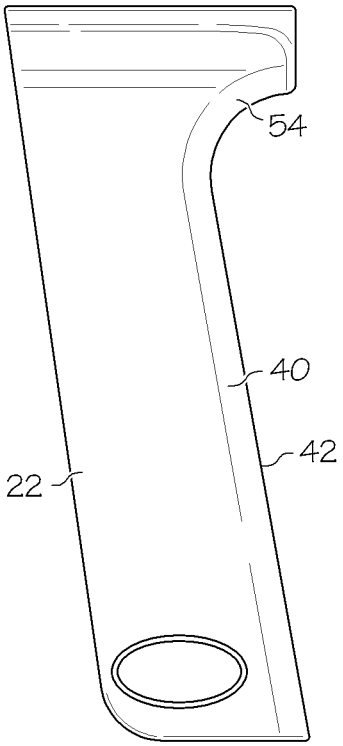
FIGS. 5 and 6 show side views of an embodiment of an archery bow grip.
Figure 6:
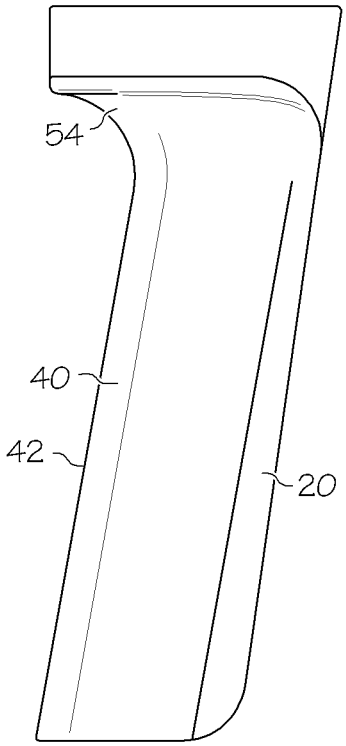
Figure 7:
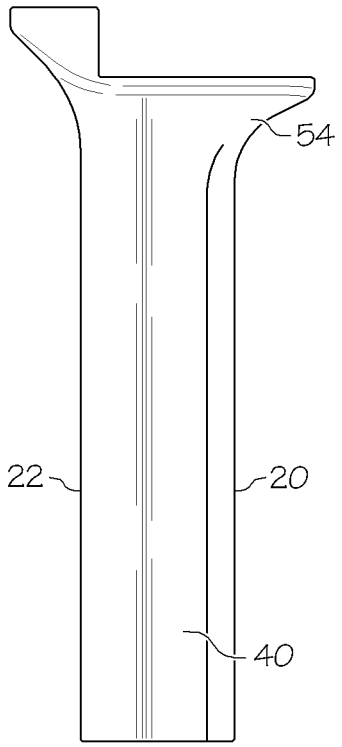
FIG. 7 shows a front view of an embodiment of an archery bow grip.
Figure 8:
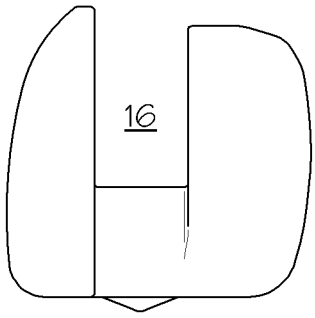
FIG. 8 shows a top view of an embodiment of an archery bow grip.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow grip 10 suitable for use with any type of archery bow. The grip 10 can be attached to an archery bow (see e.g. FIG. 10), for example being attached to an archery bow riser using any suitable method of attachment. In some embodiments, the invention comprises an archery bow having a grip 10 as disclosed herein. In some embodiments, an archery bow is shaped complimentary to the shape of the grip 10, such that the grip 10 is matingly positioned and received by the archery bow.

The grip 10 can be formed using any suitable process, and can be made from any suitable material. In various embodiments, the grip 10 comprises one or more polymers, rubbers, wood, metal or any other suitable material, as well as various combinations thereof. In some embodiments, the grip 10 can be formed by removing material from a larger base material or perform. In some embodiments, the grip 10 can be molded, cast or the like. In some embodiments, the grip 10 comprises a single piece of material.

Referring to FIGS. 1-9, in some embodiments, the grip 10 comprises a body 12 comprising a first wall 20 and an opposed second wall 22. The walls 20, 22 define a groove 16 arranged to receive a portion of an archery bow, such as a riser. The groove 16 defines a central axis 18 (see FIG. 4). In some embodiments, an inner surface 30 of the first wall 20 is planar and an inner surface 32 of the second wall 22 is planar. In some embodiments the inner surfaces 30, 32 are parallel to one another. In some embodiments the inner surfaces 30, 32 extend parallel to the central axis 18. In some embodiments, a cross-sectional shape of the groove 16 taken orthogonal to the axis 18 is substantially square or rectangular.

In some embodiments the inner surfaces 30, 32 are nonparallel to one another. Thus, in some embodiments, a cross-sectional shape of the groove 16 taken orthogonal to the axis 18 is trapezoidal. In some embodiments, the inner surfaces 30, 32 can comprise curvature that can be convex and/or concave with respect to the axis 18. Embodiments having curved inner wall surfaces 30, 32 may be better configured to resiliently engage an archery bow.

The grip 10 further comprises a connecting wall 40 that spans between the first wall 20 and the second wall 22. In some embodiment, the connecting wall 40 comprises an inner surface 34 that defines the groove 16.

An outer surface 36 of the connecting wall 40 comprises a ridge having a peak 42. In some embodiments, the peak 42 defines a straight line. In some embodiments, the peak 42 extends parallel to the axis 18 of the groove 16. In some embodiments, the peak 42 and the central axis 18 are oriented in a common plane.

The grip 10 is generally mounted to a bow such that the peak 42 extends parallel to a central axis of the bow. Desirably, the bowstring of the bow will travel in a plane when the bow is drawn and released, and the peak 42 is oriented in the plane of travel.

The connecting wall 40 is generally placed in compression when the grip 10 is attached to an archery bow and the bow is drawn. An archer's hand will generally abut the outer surface 36 of the connecting wall 40 and apply forces to the connecting wall 40 that are approximately equal to the draw weight of the bow, such as 60 pounds, 70 pounds, etc.

The shape of the connecting wall 40 (e.g the ridge and peak 42) and alignment of the peak 42 in the bowstring plane helps to prevent lateral forces and moments from being applied to the bow by the hand of the archer that engages the grip 10. The reactive forces are desirably concentrated on the peak 42, which reduces and relieves forces that would normally be applied to the grip 10 at locations lateral to the bowstring plane (e.g. on either side of the peak 42). Thus, the shape of the ridge and peak 42 reduce undesirable force transfer and retain force reactions in the plane of the peak 42, which is desirably also the plane of bowstring travel.

In some embodiments, the ridge comprises a first portion 46 and a second portion 48 located on opposite sides of the peak 42, which meet at the peak 42. At least a portion of the first portion 46 is nonparallel to the second portion 48. In some embodiments, the first portion 46 and the second portion 48 are mirror images of one another. In some embodiments, a width dimension of the grip that is occupied by the peak 42 is less than a width dimension of the grip that is occupied by the first portion 46 or the second portion 48.

Figure 9:
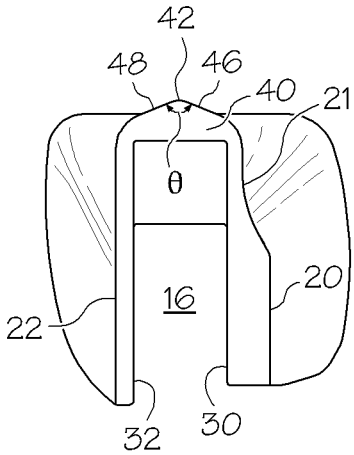
FIG. 9 shows a bottom view of an embodiment of an archery bow grip.

In some embodiments, the first portion 46 and the second portion 48 are flat, wherein each may comprise a planar surface. With reference to FIG. 9, the first portion 46 is oriented at an angle θ to the second portion 48. In various embodiments, the angle θ can be selected as desired, for example ranging from approximately 160 degrees to 90 degrees or less. A higher angle θ may result in greater comfort for the shooter. A lower angle θ may further reduce undesirable force transfer, and also allow for a shooter to better feel the specific orientation of the grip 10 in the hand, thus allowing better consistency in hand placement. In some embodiments, the angle θ ranges from 140 degrees to 130 degrees. In some embodiments, the angle θ is approximately 135 degrees.

In some embodiments, the first portion 46 comprises curvature. In some embodiments, the second portion 48 comprises curvature. In some embodiments, the curvature is convex with respect to the central axis 18 of the groove 16, thus resulting in a sharper peak 42. In some embodiments, a slope of the curvature increases closer to the peak 42. In various embodiments, the curvature can be arcuate, elliptical, parabolic, etc. When the first and second portions 46, 48 comprise curvature, the angle θ between the first and second portions 46, 48 near the peak 42 can be any suitable angle greater than zero.

In some embodiments, the peak 42 is configured to be different from the first portion 46 and second portion 48 of the connecting wall 40. In some embodiment, the peak 42 comprises a different color than the first portion 46 and second portion 48. In some embodiment, the peak 42 comprises a different material than the first portion 46 and second portion 48, for example having a different coefficient of friction.

The grip 10 is desirably configured for either left or right hands. FIGS. 1-9 depict a right-handed grip, which would be used in a right-handed bow, wherein the right hand grasps the bowstring and the left hand grasps the grip 10. The invention also comprises mirror images (e.g. left-handed versions) of the embodiments disclosed herein.

As shown in FIGS. 1-9, in some embodiments, the second wall 22 is thin, for example having a thickness dimension of 3⁄32" or less. A portion of the archer's palm will typically abut an outer surface of the second wall 22. In some embodiments, the outer surface of the second wall 22 is flat. In some embodiments, the outer surface of the second wall 22 comprises curvature, for example being concave with respect to the axis 18.

The archer's finger tips will typically abut an outer surface 38 of the first wall 20. The first wall 20 can be flat; however, in some embodiments, the first wall 20 is shaped to allow the fingertips to grasp the grip 10. In some embodiments, the outer surface 38 of the first wall 20 comprises a curved portion 21. In some embodiments, the curvature is convex with respect to the axis 18. In some embodiments, the thickness of the first wall 20 increases as it extends away from the connecting wall 40. Thus, the first wall 20 can have a thickness similar to the second wall 22 near the connecting wall 40 and can flare to a larger thickness as the distance from the connecting wall 40 increases. The flaring is most visible in FIGS. 1, 2 and 9.

In some embodiments, the first wall 20, second wall 22 and connecting wall 40 can each flare outwardly near the top of the grip 10, forming a flange 54. The flange 54 is shaped to comfortably abut portions of the thumb, index finger and web between the thumb and index finger of an archer.

Figure 10:
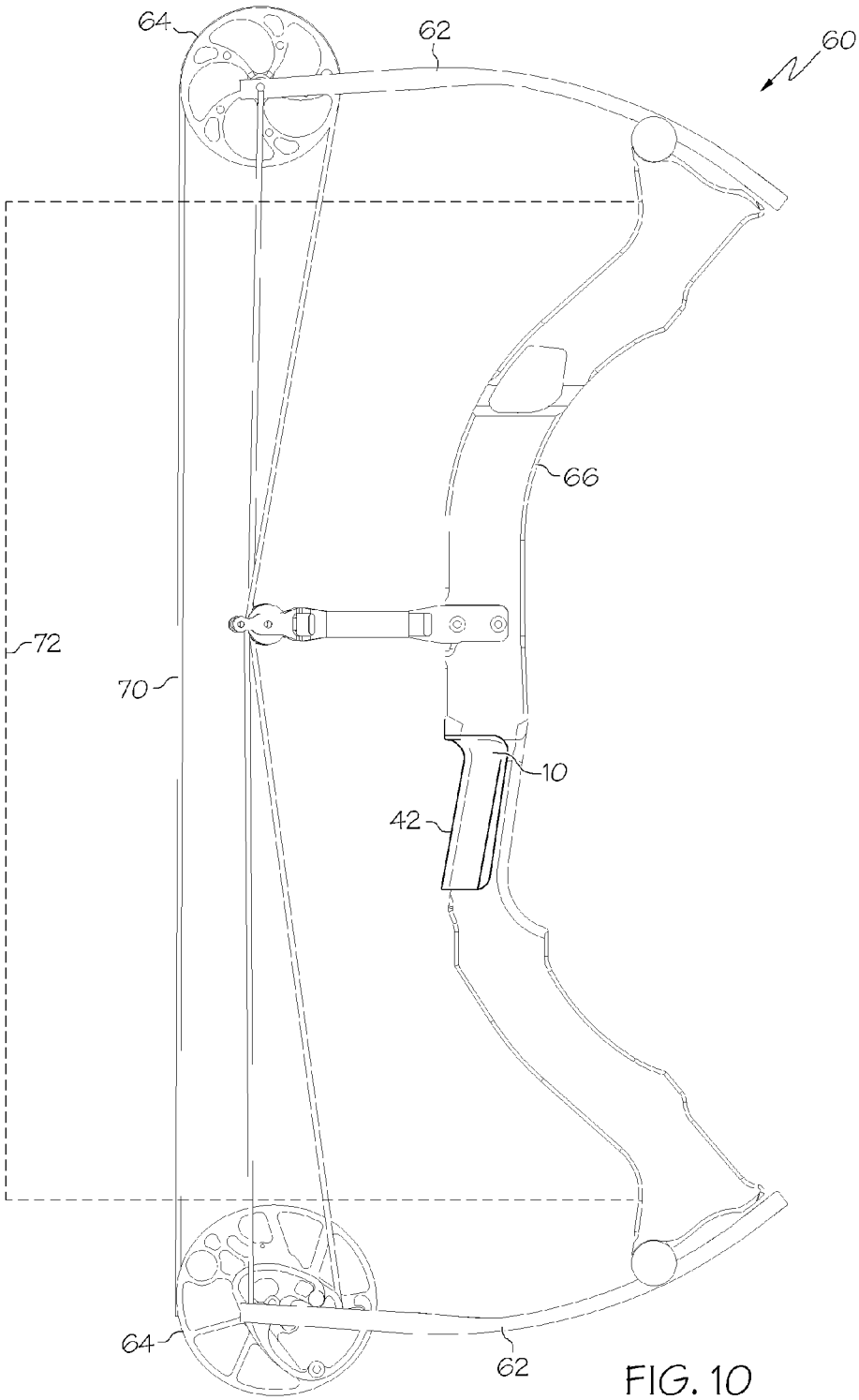
FIGS. 10 and 11 each show an embodiment of an archery bow grip on an archery bow.
Figure 11:
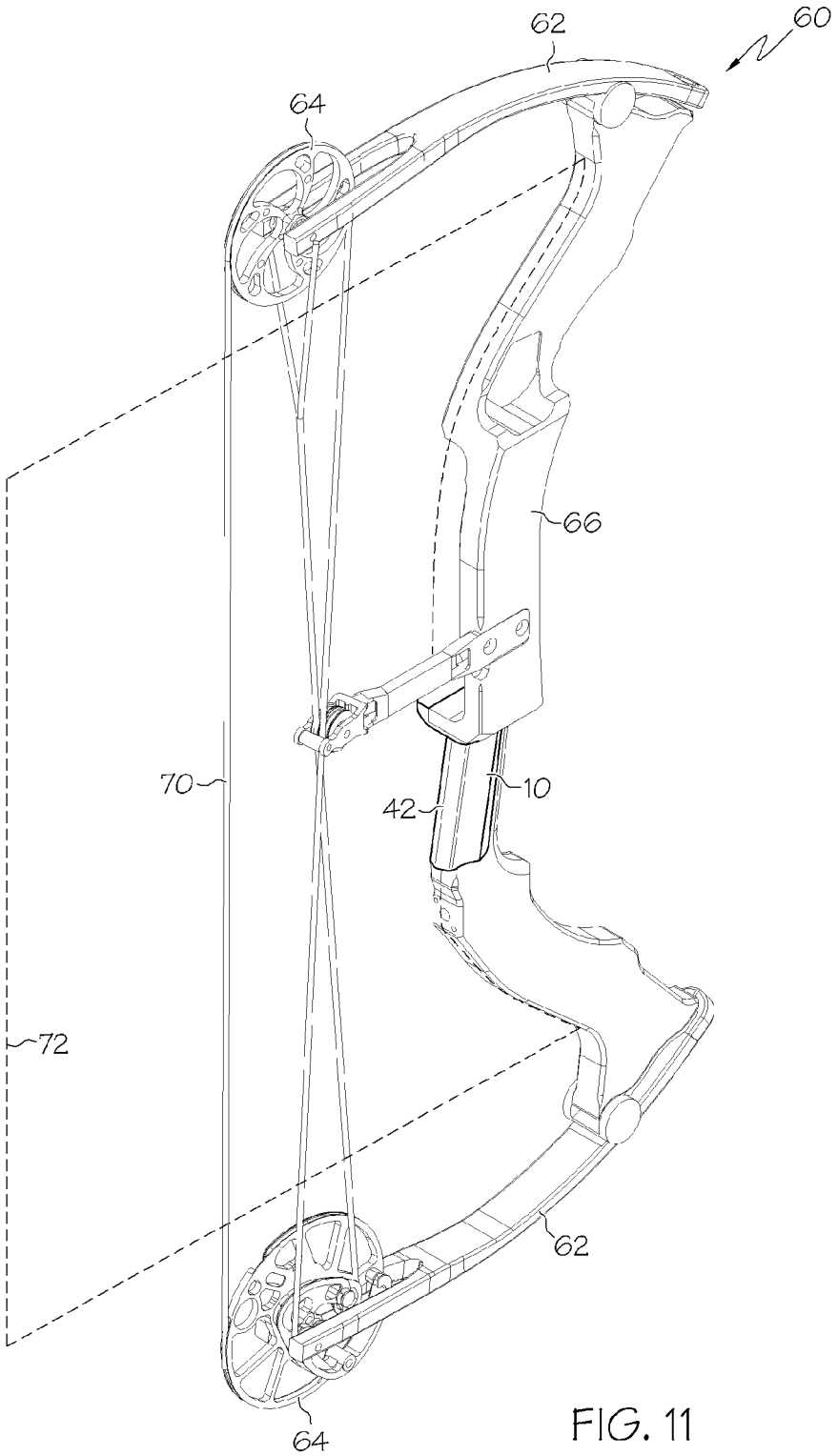

FIGS. 10 and 11 show an embodiment of an archery bow 60 comprising a grip 10 as disclosed herein. The bow 60 comprises a riser 66, opposed limbs 62 and a bowstring 70. The grip 10 is attached to the riser 66, wherein the connecting wall 40 (see e.g. FIG. 1) is oriented between the riser 66 and the bowstring 70. As illustrated, the bow 60 comprises a compound bow having rotatable members 64, wherein at least one rotatable member comprises a cam. Other examples of bows are disclosed, for example, in US 2010-0089375 and US 2008-0127961, the entire contents of which are hereby incorporated by reference herein.

In theory, the bow 60 defines a plane 72, and the bowstring 70 moves in this plane 72 when the bowstring 70 is drawn and/or released. Many parts of the bow 60 are centered on the plane 72. The grip 10 is arranged on the riser 66 such that the peak 42 is in the plane 72.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow grip comprising:

a body portion comprising a first wall and an opposed second wall, a connecting wall spanning between the first wall and the second wall, the body portion defining a groove between an inner surface of said first wall and an inner surface of second wall, the groove defining a central axis;

the connecting wall comprising a ridge having a first portion and a second portion that meet at a peak, said peak extending parallel to the central axis of the groove, said peak being straight along its length, said first portion and said second portion each being non-concave with respect to said central axis.

2. The archery bow grip of claim 1, wherein said inner surface of said first wall is parallel to said inner surface of said second wall.

3. The archery bow grip of claim 1, wherein an outer surface of the connecting wall defines said ridge and an inner surface of the connecting wall defines said groove.

4. The archery bow grip of claim 1, wherein said first portion is flat and said second portion is flat.

5. The archery bow grip of claim 4, wherein an angle between the first portion and the second portion is 130 to 140 degrees.

6. The archery bow grip of claim 4, wherein an angle between the first portion and the second portion is approximately 135 degrees.

7. The archery bow grip of claim 1, wherein said first portion and said second portion each comprise curvature that is convex with respect to said central axis.

8. The archery bow grip of claim 7, wherein said curvature is elliptical.

9. The archery bow grip of claim 1, wherein said first wall comprises a portion that is thicker than said second wall.

10. The archery bow grip of claim 1, wherein an outer surface of said first wall comprises curvature.

11. The archery bow grip of claim 10, wherein said curvature is convex with respect to said groove.

12. The archery bow grip of claim 1, wherein at least a portion of said peak is different from the remainder of said connecting wall.

13. The archery bow grip of claim 12, wherein at least a portion of said peak comprises a different material than the remainder of said connecting wall.

14. The archery bow grip of claim 12, wherein at least a portion of said peak comprises a different color than the remainder of said connecting wall.

15. An archery bow comprising:

a riser, opposed limbs and a bowstring extending between said limbs; and a grip attached to said riser, said grip comprising a wall oriented between said riser and said bowstring, said wall comprising a ridge having a first portion and a second portion that meet at a peak, the peak being straight along its length, said first portion and said second portion each being non-concave with respect to a portion of said riser located under said grip;

wherein said bow defines a plane, said bowstring moving in said plane when the bow is drawn, said peak oriented in said plane.

16. The archery bow of claim 15, wherein said first portion is flat and said second portion is flat.

17. The archery bow of claim 16, wherein an angle between the first flat portion and the second flat portion is 130 to 140 degrees.

18. The archery bow of claim 16, wherein an angle between the first flat portion and the second flat portion is approximately 135 degrees.

19. The archery bow of claim 15, wherein said first and second portions are each convex with respect to said portion of said riser located under said grip.

20. An archery bow comprising:

a riser, opposed limbs and a bowstring extending between said limbs, said riser comprising a grip comprising a surface that faces the bowstring, the surface comprising a peak oriented between a first flat portion and a second flat portion, the first flat portion being non-parallel to the second flat portion;

wherein said bow defines a plane, said bowstring moving in said plane when the bow is drawn, said peak oriented in said plane.

* * * * *